US009592520B2

(12) United States Patent
Roide

(10) Patent No.: US 9,592,520 B2
(45) Date of Patent: Mar. 14, 2017

(54) MULTIPLE STATION HVLP SPRAY COATING SYSTEM

(71) Applicant: Paul Anthony Roide, Palm Springs, CA (US)

(72) Inventor: Paul Anthony Roide, Palm Springs, CA (US)

(73) Assignee: Paul A. Roide, Palm Springs, CA (US)

( * ) Notice: Subject to any disclaimer, the term of this patent is extended or adjusted under 35 U.S.C. 154(b) by 258 days.

(21) Appl. No.: 14/176,995

(22) Filed: Feb. 10, 2014

(65) Prior Publication Data

US 2015/0224524 A1 Aug. 13, 2015

(51) Int. Cl.

| | |
|---|---|
| ***B05B 9/01*** | (2006.01) |
| ***B05B 7/24*** | (2006.01) |
| ***F04C 2/344*** | (2006.01) |
| ***F04C 13/00*** | (2006.01) |
| ***F04C 14/24*** | (2006.01) |
| *F01C 13/02* | (2006.01) |
| *A62B 7/12* | (2006.01) |

(52) U.S. Cl.

CPC ..... *B05B 7/2464* (2013.01); *B05B 7/2486* (2013.01); *B05B 7/2491* (2013.01); *F04C 2/344* (2013.01); *F04C 13/002* (2013.01); *F04C 14/24* (2013.01); *A62B 7/12* (2013.01); *F01C 13/02* (2013.01)

(58) Field of Classification Search

CPC ..... B05B 12/085; B05B 9/007; B05B 15/00; B05B 7/2475; B05B 9/0403; B05B 9/01; B05B 12/002; B05B 7/2464; B05B 7/2486; B05B 7/2491; A62B 18/006; A62B 7/12; F04C 2/344; F04C 13/002; F04C 14/24

USPC ..... 239/71, 146, 175, 270, 289, 302–305, 239/373, 525, 526

See application file for complete search history.

(56) References Cited

U.S. PATENT DOCUMENTS

| | | | | |
|---|---|---|---|---|
| 5,058,807 | A * | 10/1991 | Smith | B05B 7/0081 239/302 |
| 5,240,181 | A * | 8/1993 | Uribe | B05B 7/0081 239/302 |
| 5,611,485 | A * | 3/1997 | Davis | B05B 7/24 239/270 |
| 6,715,692 | B2 * | 4/2004 | Peterson | B05B 7/2494 239/303 |
| 2008/0124698 | A1 * | 5/2008 | Ebensberger | G09B 9/00 434/365 |

* cited by examiner

*Primary Examiner* — Steven J Ganley

(57) ABSTRACT

A high volume low pressure (HVLP) coating application system employing a rotary vane pump and manifold assembly that provides an improved source of air for increased spray gun atomization of high solid coatings and faster applications of more even coated surfaces with continuous HVLP pressures of 10 PSI at the spray gun output and the ability to power multiple spray guns and breathing apparatus from a single manifold system.

3 Claims, 7 Drawing Sheets

MULTIPLE STATION HVLP SPRAY COATING SYSTEM

FIELD OF THE INVENTION

The present invention relates to the field of coating delivery systems that are used in commercial applications to deliver paint and other liquids to surfaces requiring coatings for protection, enhancement, product coloring or texture and for multiple other reasons. There are many coating delivery technologies that have developed and are used in the field. The coatings field can be broken down by industry categories that use specific coating delivery technologies based on application, types of coatings and economy of delivery. Architectural coatings for building and structures require a different type of delivery system than does automotive or aircraft finishes. For coating buildings, the primary concern is the speed of delivery and getting a complete and heavy coating, whereas in automotive coating the focus is precision and control with attention to detail in getting a thin, even coat and adding multiple layers to achieve durability with a consistent finish. Each would have their own coating delivery system focused on the specific need or requirement of the end product and process.

The majority of coating applications systems found today utilize piston type compressors that pump air into storage tanks that supply multiple spray guns and deliver high pressure, low volume air for high speed, low cost performance. These systems are known as conventional compressed air delivery systems. They deliver coatings at pressures that range from 20 to 50 PSI and achieve only 40-60% transfer efficiency in the process. That means that on average for very gallon of paint applied about one half (½) of the paint is lost in the coating process. Another common high speed process involves pressurizing the coating solution direct and applying it without any air. This coating process is known as airless coating. It applies with liquid pressure in the range of 1000 PSI and although very fast and effective in applying coatings it also has a low transfer efficiency (40-60%) and wastes almost as much paint as is applied due to the extreme high pressures the coatings are under and the tremendous amount of overspray that is generated. Airless technology has evolved in recent years to include air assisted combinations where some air is introduced into the spray process to help atomize the coating before application but still has low transfer efficiencies and generates an abundance of overspray and material waste. There are other coating application technologies such as Electro-Coat where the coating material is charged with a current and the opposite current is induced into the material to be painted, creating an electron bond that increases the precision of the coating delivery and reduces overspray. Although highly efficient in use with good transfer efficiency this system is expensive, slow for large scale coating applications and cannot be used coating materials that do not conduct electricity such as plastics or wood.

The Field of the present invention is in the HVLP spray type coatings transfer where air is used to propel the atomized coating at pressures under 10 PSI. This is known as High Volume, Low pressure or the HVLP delivery system designed for precise coating delivery to smaller surfaces with little material waste or coating overspray or waste. The higher volume of air is used to more completely atomize or aerosolize the coating while the lower pressure is used to propel the paint. The result is a higher proportion of paint reaching the target surface with reduced overspray, material consumption and air pollution. This technology has been in use since the 1980's when various U.S. Federal EPA (Environmental Protection Agency) and State agencies started controlling the amount of overspray produced by painting in urban areas which generated volatile organic compounds (VOC's) know to cause adverse health risks. One such agency in Southern California known as the South Coast Air Quality Management District (SCAQMD) began regulating harmful emissions from paint overspray in the mid 1980's and tested HVLP spray systems finding them to be over 65% efficient in transferring their coatings, a major breakthrough in achieving less pollution for this industry. HVLP technology was adopted by the SCAQMD, EPA and others and was defined as high volume, low pressure coating system operated at air pressures of between 0.1 and 10 PSI. Since that time HVLP manufacturers have set 10 PSI as the goal for maximum output and have tried to achieve it in two different ways. One way was by using conventional compressed air pump systems attached to HVLP modified standard spray guns designed to deliver 10 PSI. This is known as standard HVLP technology. The second way was to use small turbine motors that generate more volume and less pressure and by designing an HVLP gun to operate at the lower pressures with larger internal passage ways and larger spray tip openings to accommodate the lower pressure outputs. This system is known as true HVLP technology. Transfer efficiencies have increased greatly and have even been tested at above 80% in some cases. HVLP technology has quickly become the standard for low waste, ecological sensitive coating applications.

BACKGROUND OF THE INVENTION

HVLP technology has developed in two ways as mentioned above. The first and easiest adaptation was changing the gun design while continuing to use the standard compressed piston air system. Here the standard piston type pump pushes air into a storage tank which is connected directly to the paint gun and used on demand. Pressures from the tank can be 30 to 100 PSI (depending on where the tank pressure is set) which is then reduced to HVLP pressures of less than 10 PSI inside the spray gun. This type of system is know as Standard HVLP where the gun is designed to release a controlled amount of compressed air into a larger chamber that expands to create the air volume needed for HVLP application. U.S. Pat. No. 5,429,307 details such a design where a gun has been designed to accept either type of air source, compressed air from conventional piston pumps or HVLP air from a turbine pump, by means of a simple adjustment on the gun. Air volume for True HVLP systems is produced directly by turbine type pumps with guns designed to operate at the lower pressures. True HVLP guns are designed to have large passageways to accept the lower pressure from the HVLP turbine and propel the coating at almost the same pressure as it received minus air losses within the gun. The Standard HVLP compressors have high pressure but lack the volume necessary to atomize the coating whereas the True HVLP turbine has the necessary volume required for light atomizing but many times lacks the pressure to deliver the coating at 10 PSI, the maximum permitted by HVLP regulations. Standard HVLP is not as efficient as True HVLP and can typically achieve 55-65% maximum transfer efficiency while the True HVLP systems with stacked Turbines and True HVLP guns have achieved 70 to 80% transfer efficiencies and are therefore the preferred method of HVLP. An additional advantage that True HVLP systems have over the Standard HVLP is that the Standard piston type pumps that have rings and seals that often leak exhaust particles, water and lubricating oil. The air they pump cannot be used for atomizing coatings or for fresh air breathing without adding costly filters and regular maintenance. The True HVLP turbine pumps are oil less, and keep the air stream clean and free from contaminates so atomized coatings are particle and pollution free without such cost and maintenance.

Since the 1980's when HVLP technology became accepted as a viable alternative to convention spray systems, manufactures have developed turbine style motors like those found in vacuum cleaners that can be stacked to achieve larger amounts of pressure at the output. A typical flat or "pancake" style turbine can produce 20 CFM of air volume but only 2-3 PSI of output pressure. So HVLP manufactures began stacking the turbines in series to produce more air pressure and approximate the 10 PSI maximum allowed by HVLP protocol. Unfortunately stacking these individual turbine elements creates inherent heat and inefficiencies and the practical maximum any manufacturer has been able to achieve to date in output pressure is around 7 PSI, or 30% below the allowable and optimum HVLP pressure allowed. Not having the maximum 10 PSI allowed at the Spray gun tip limits the amount of coating that can be applied per hour (or throughput) so even though transfer efficiency is increased so is the application times leading to higher coating costs.

The secret to producing a good quality finish is finding a balance between atomizing pressure and fluid viscosity. When both are properly matched it will create good atomization of the coating and steady delivery of atomized coating suspended in air, producing a smooth, even and consistent finish when dry. Unfortunately, most present day HVLP systems are able to atomize only low solid coating formulations so their application and value is limited to only a small part of the coating business. The present invention details using a rotary vane HVLP turbine, as opposed to conventional "pancake" or stacked type HVLP turbine and has the advantage of being able to produce an excess volume of air which can be used to atomize high solid coating formulations, power multiple guns and simultaneously and provide a fresh air breathing system for the spray operators. The stacked pancake style HVLP turbine is limited in volume and therefore no extra air is available to supply breathing systems. The rotary vane pump of present invention has a clear advantage in output capacity but is expensive in comparison. So the present invention also provides a means to overcome the cost disadvantage of the rotary vane pump as applied to HVLP coatings applications by means of a manifold that allows one pump to supply multiple guns as well as a fresh air breathing system for the spray operator. By utilizing a rotary vane pump in place of the conventional stacked turbine the present invention has been able to achieve 10 to 16 PSI of pressure to allow for losses within the system so that the final output at the spray gun cap can be 10 PSI which meets the optimum operating conditions of HVLP operation. The use of the rotary vane pump in the present design also allows 50-70 CFM of output volume, for atomizing high solid coatings, supplying multiple HVLP guns and providing fresh air for controlled operator breathing through air mask assemblies. Current true HVLP technologies all utilize stacked style turbine motors because they are relatively inexpensive and inherently efficient. They have the disadvantages of having a short operational life and are noisy, but their greatest limitation is not having the capability to deliver the necessary 10 PSI air pressure required for most industrial HVLP applications and having enough volume to atomize high solid coatings. Another disadvantage is that they heat the air that is compressed causing heat curing, a premature chemical reaction within the coating as it is applied which affects the finish. The present invention overcomes all these limitations.

Due to the concern for VOC pollution, more coating producers are formulating their coatings with higher solid content, which helps limit VOC emissions but requires extra volumes of air to atomize. Convention HVLP turbines do not have the capacity to atomize many of these formulations. Because of these and other technical drawbacks, the HVLP field of coating applications today has been restricted to smaller project painting of limited sized objects with coatings of low solid content (easy to atomize). One popular HVLP application today is use in furniture spraying where small items such as chairs and tables are sprayed with lightweight materials like lacquer and clear enamel with delivery rates and production times that are not cost critical. The throughput of the current HVLP paint systems or the amount of paint that can be delivered per a given timeframe is small compared to other Systems so for many coating applications, HVLP has no practical or economical use despite the fact that it has much higher transfer efficiency. The present invention is designed to overcome the pressure delivery and atomization problems of the stacked turbine HVLP technology by providing a pump powered by a rotary vane turbine that is not limited in delivery pressure or atomizing volume. This excess pressure and volume capacity fit the HVLP model well since it can now deliver the maximum HVLP output pressures of 10 PSI at the spray gun cap or output with enough excess pressure to accommodate system losses, while its ability to generate large volumes of air, as compared to conventional HVLP stacked turbines allow it to atomize high solid coatings with ease. The added volume capacity along with the unique manifold design of the present invention allows the rotary vane pump to supply multiple spray gun outputs, increasing coating efficiency and lowering application costs. This added volume can also be used to supply a fresh air breathing and cooling apparatus for the spray gun operator. Fresh air for coating operators is a critical requirement where large amounts of coatings are sprayed in a closed or restricted space area such as an airplane hanger or a military maintenance depot or where toxic coatings are being used such as CARC, chemical agent reactive coatings. Current technology requires spray operators to carry their own air supply in these situations which consists of tanks strapped on their backs, limiting range and motion of the operator as well as causing operator fatigue. The present invention overcomes the problems by supplying fresh filtered air into a sealed mask at each spray station which can be individually adjusted by the operator. Air from the rotary vane pump is clean, there is no oil or water as there is with conventional piston pumps so the need for external air filtering is minimized. All this is accomplished from a single output manifold without the need for oxygen storage tanks, filters or elaborate breathing systems that hinder the efficiency and increase the costs of coating process. The present invention provides a break through design for the HVLP market because all previously mentioned limitations of HVLP spray technology are now eliminated. HVLP Spraying can now be applied to large scale coating targets with increased coating atomization, delivery speed and delivery performance. Coatings can be produced that are more even, contain less air bubbles, pits and other surface imperfections, all while creating less overspray and coating waste. Having the multiple spray stations possible from one pump source increases coating productivity and efficiency by orders of magnitude and having a fresh air source for operator breathing allows the system more versatility and range of applications never possible with previous HVLP designs.

The present design also has a coating supply system that is central and independently pressurized, which directly supplies each gun via a hose reducing the down time of the spray coating process. Typically, most HVLP spray systems utilize a gun that contains a cup reservoir that must be re-filled many times during the operation, causing time consuming delays and labor inefficiencies. The present design eliminates the need for a spray gun cup reservoir and supplies the coating direct via hose under operator adjustable pressure greatly increasing coating delivery efficiency and performance saving labor costs.

SUMMARY OF INVENTION

Understanding the limitations that Standard HVLP compressor pumps and convention flat turbine HVLP pumps present to the HVLP spray coating process and their inability to atomize high solid coatings and supply enough air pressure to meet the 10 PSI standard that allows for system losses, the present invention overcomes these current limitations by providing a system that allows commercially available rotary vane type pumps of adequate capacity to be attached to a manifold and regulator assembly to meet and exceed the air pressure requirements of the HVLP coating process and provide enough volume to atomize high solid type coatings that present day HVLP systems have not been able to. This while simultaneously supplying multiple spray guns/stations and a fresh air breathing system for each of its station operators. The pairing of the rotary vane type pump with the manifold design assembly will allow the HVLP coating process to be applied to a wider variety of applications not previously possible and to be more cost efficient by increasing the number of spray stations possible, increasing the speed and coverage of the delivery (feet/minute) along with the overall transfer efficiency achieved in the coating process. This is accomplished by supplying higher output air pressures (up to 10 PSI) without heating or polluting the air and having enough excess air volume to atomize higher solid coatings and provide a wider dynamic range within the atomization process, allowing greater control of coating coverage, thickness, and delivery rate. This control will increase the uniformity of the coatings delivered, reduce the amount of overspray of material wasted and increase the speed in which the coating can be applied, saving money in material and labor costs.

It is therefore an object of the present invention to provide a more balanced and efficient air pump and manifold system that will not be limited in meeting the maximum HVLP air pressure output of 10 PSI. Another objective of the present invention is to use a rotary vane type pump as an air pump source which is commercially available, extremely reliable, does not heat or pollute the air, is relatively economical to use when supplying multiple spray guns and which provides a better balance of air pressure and volume very well suited to the HVLP application. A further objective of the present invention is to provide a manifold and regulator design to create a reserve of air volume and to supply multiple HVLP spray guns, each with enough air volume to atomize a wider range of coating formulations in the HVLP spray process, including high solid coatings, allowing for a broader range of HVLP applications and a wider dynamic range between atomizing pressure and fluid viscosity. A further objective of the present invention is to provide a manifold design to supply multiple spray guns to allow teams of painters to work together in the HVLP coating of larger surfaces such as aircraft, transport vehicles, aerospace and military vessels. Yet a further objective of the present invention is to provide a manifold design to simultaneously accommodate a fresh air breathing and cooling system to be used in conjunction with each spray gun supply line. Yet a further objective of the present invention is to provide a new and improved coating supply system that allows the coating for each gun to be supplied from a centralized source under pressure from an external hydraulic pump, which regulates the pressure and supplies each spray gun coating by means of a hose, maintaining it at an operator adjustable level, replacing the conventional gun cup reservoir and the need to stop and re-fill it during the coating process. Yet a further objective of the present invention is to combine the above designs into a portable, centrally controlled and automated system which supplies the HVLP coating process with the air pressure and volume necessary to apply higher solid coatings with more consistent thickness and apply them with greater speed and throughput of coverage (amount of coating surface applied per hour), while delivering high coating transfer efficiencies and lower coating overspray, saving both labor time and material costs and minimizing the environmental impact (release of volatile organic compounds) in the coating process. The final objective of the present design is to make the above described system modular, interchangeable and able to work in conjunction with each other by means of a central computer processor with sensory feedback devices and wireless control, so that any number of core coating pods or stations (4, 6, 8, 10 units each) can be controlled and coordinated from a central source. By this means, very large coating targets such as jumbo jet aircraft could have multiple pod stations spraying multiple types of materials at multiple targets all controlled by a central system that monitors and regulates the performance of each core pod by means of sensors and computer feedback to the control station.

BRIEF DESCRIPTION OF THE DRAWINGS

FIG. 2A shows an external view of the pump and FIG. 2B shows an internal view.

FIG. 5A is a side view of the pump and FIG. 5B is a cross-sectional view.

DETAILED DESCRIPTION

Figure 1:
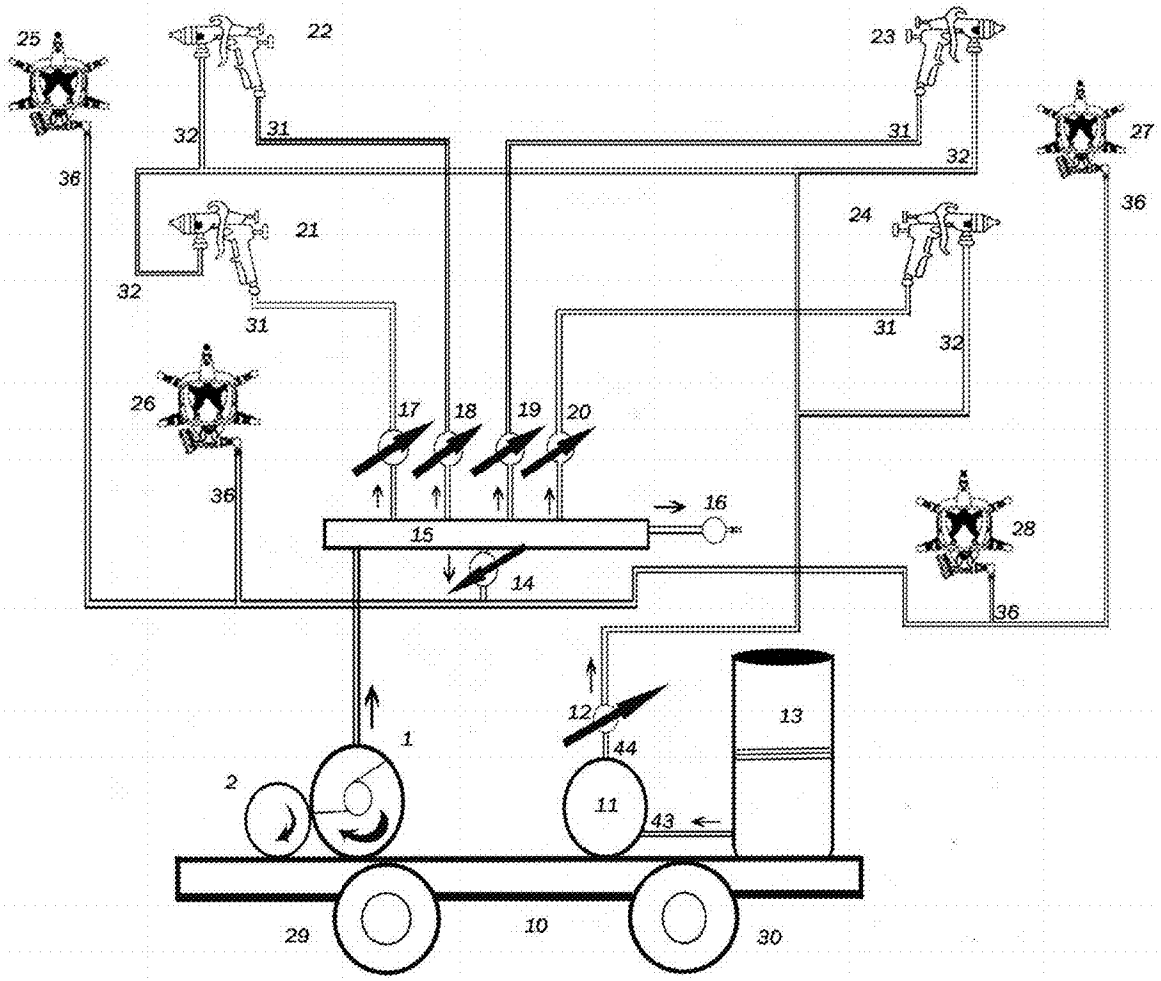
FIG. 1 is a diagram showing the present invention applied to four (4) spray stations.

One preferred embodiment of the present invention is shown in FIG. 1. The center of the design is the rotary vane pump 1, powered by an electric motor 2 that provides air to the manifold 15. The manifold is the center of the present invention where air from above source is distributed to both the HVLP spray guns, 21, 22, 23 and 24, along with the fresh air operator breathing apparatus 25, 26, 27. 28. Air to each of the four spray guns is individually regulated by regulators 17, 18, 19, and 20 and connect at each of the four guns at 31, the air input side of the spray guns. Individual air regulators allow losses in each line to be different due to hose length, type of gun, atomization rate, etc where each regulator can be adjusted to compensate. Air pressure regulator 14 regulates manifold pressure to each of the fresh air operator breathing apparatuses sourced at 36 and each breathing mask has its own adjustment, item 37 of FIG. 4. The gun air regulators will adjust the air within the manifold to meet the 10 pounds per square inch (PSI) requirement of the HVLP system at the cap of each of the spray guns 35 of FIG. 3, allowing for system losses in each line. The manifold contains an over pressure or relief valve 16 which prevents excessive pressure build up within the manifold and exhausts over pressured air out and away from the internal connections of the system at a specific adjustable pressure. The system rests on a portable cart 10 having wheels 29 and 30 that allow movement freely around the coating application areas. The coating reservoir 13 contains a large drum of coating material, typically of 55 gallon capacity or similar industry standard container(s). Hydraulic pump 11 pumps the coating liquid out of the reservoir 13 and into the liquid pressure regulator 12 and into the supply lines to each of the four spray guns at 32.

Figure 7:
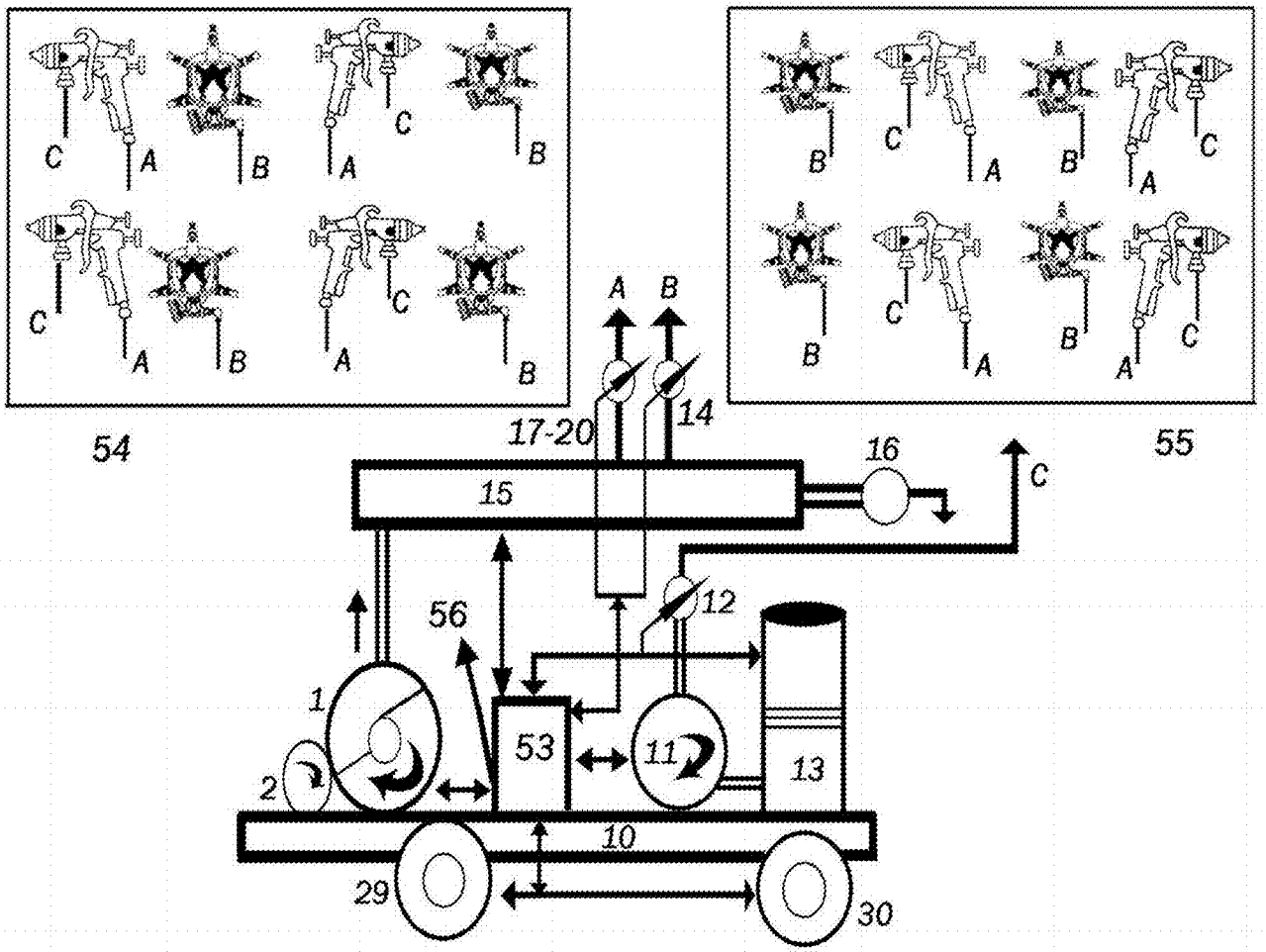
FIG. 7 shows a system level schematic of how multiple core stations of the present invention of FIG. 1 could be connected to allow for command and control of spraying modules for multiple coatings at multiple locations on the same coating target. Items 54 and 55 show the spray modules that can be added or subtracted from the system.

FIG. 1 shows the overview of the present invention embodying four spray guns and utilizing four operators each with their own fresh air breathing systems. The present invention is not limited to four stations and could have more or less depending on the requirements of the coating application and size of the pump specified. Four stations represents a good average for coating applications involving large size targets such as airplanes, heavy equipment, ships, trains or large architectural surfaces requiring precise and even coating application and is cost efficient for the standard rotary vane pumps that are readily available. The concept is valid and applicable to any size and number of spray stations required for a specific application and is only limited by the size and volumetric capacity of the rotary vane pump source. Ideally the design of these four stations could represent one autonomous work pod, and on extremely large projects, multiple in dependent pods of four stations could work together to achieve a coordinated performance compatible coatings application system. FIG. 7 shows the design with eight operator stations and any multiple number of stations could be added depending on the capacity of the pump and system.

Figure 2B:
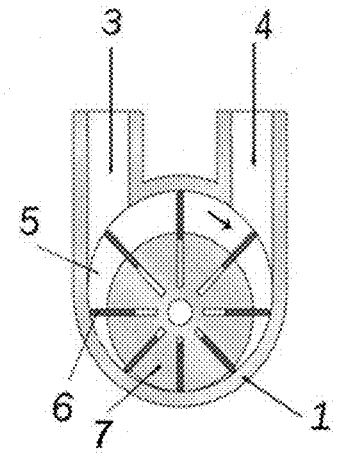
FIGS. 2A and 2B are detailed views of the Rotary vane pump and drive motor of the present invention of FIG. 1.
Figure 2A:
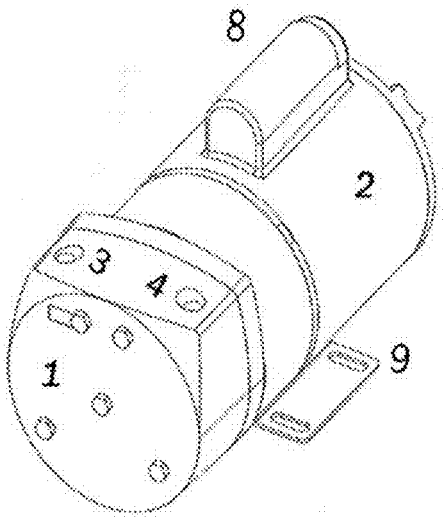
Figure 3:
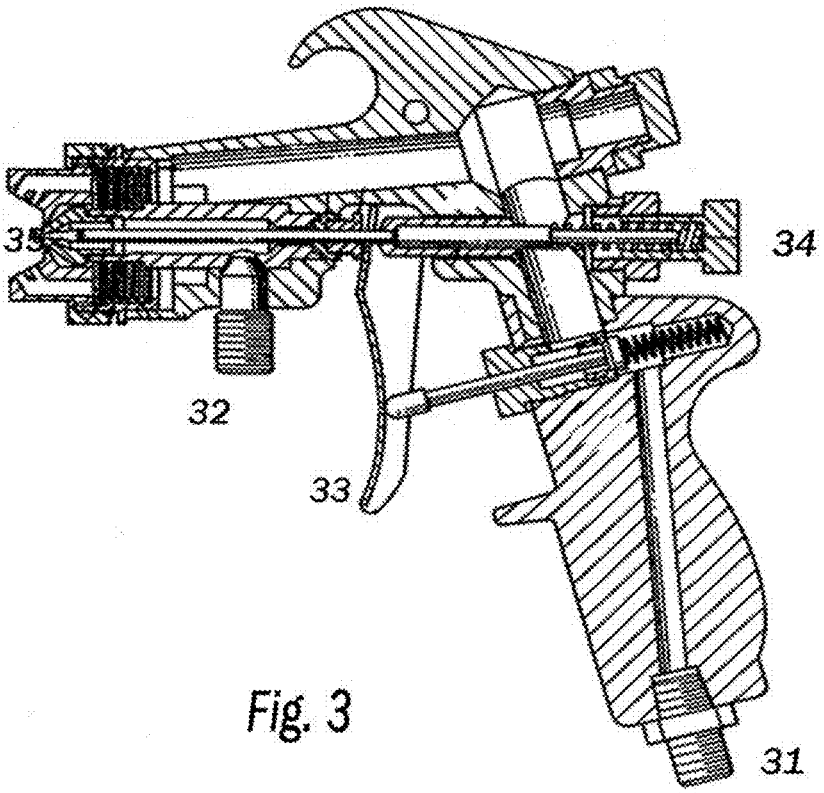
FIG. 3 is a detailed view of an HVLP spray gun used in the present invention of FIG. 1, items 21, 22, 23, and 24 in FIG. 1.

FIG. 2A shows an external view of Rotary Vane pump 1. Air is input at 3 and output 4, driven by electric drive motor 2 with starting and speed control electronics 8 and mounting base 9. FIG. 2B shows a cross sectional view of the internal workings of the rotary vane pump 1 where the turbine 7 contains blades 6 and the volute of the pump 5 allows air to enter at 3 when the turbine rotates and exhaust at 4 into the manifold 15 of FIG. 1. FIG. 3 is a detailed view of an HVLP spray gun showing the internal workings and adjustments. Air from the regulators is input at 31 where pressure input to the gun is controlled by trigger 33. Pulling the trigger 33 toward the handle allows more air to enter the gun and releasing the trigger slows down the air flow within the gun. The coating input from the hydraulic pump 11 and flow regulator 12 connect to the gun at 32. The ratio of liquid to air atomization within the gun is adjusted at 34. The cap of the gun 35 is removable to allow various spray patterns to be achieved by the design of the specific cap. The gun accomplishes atomization of the coating material at HVLP pressures of 10 PSI and delivers the output so that the operator can control output volume intensity and spray pattern delivery simultaneously, while also controlling the air to liquid ratio of the atomization occurring. When heavier coatings are required this ratio is weighted toward more liquid and when lighter coats are required the weighting shifts to more air. This is one typical version of an HVLP spray gun and others types exist and are equally compatible with the present invention.

Figure 4:
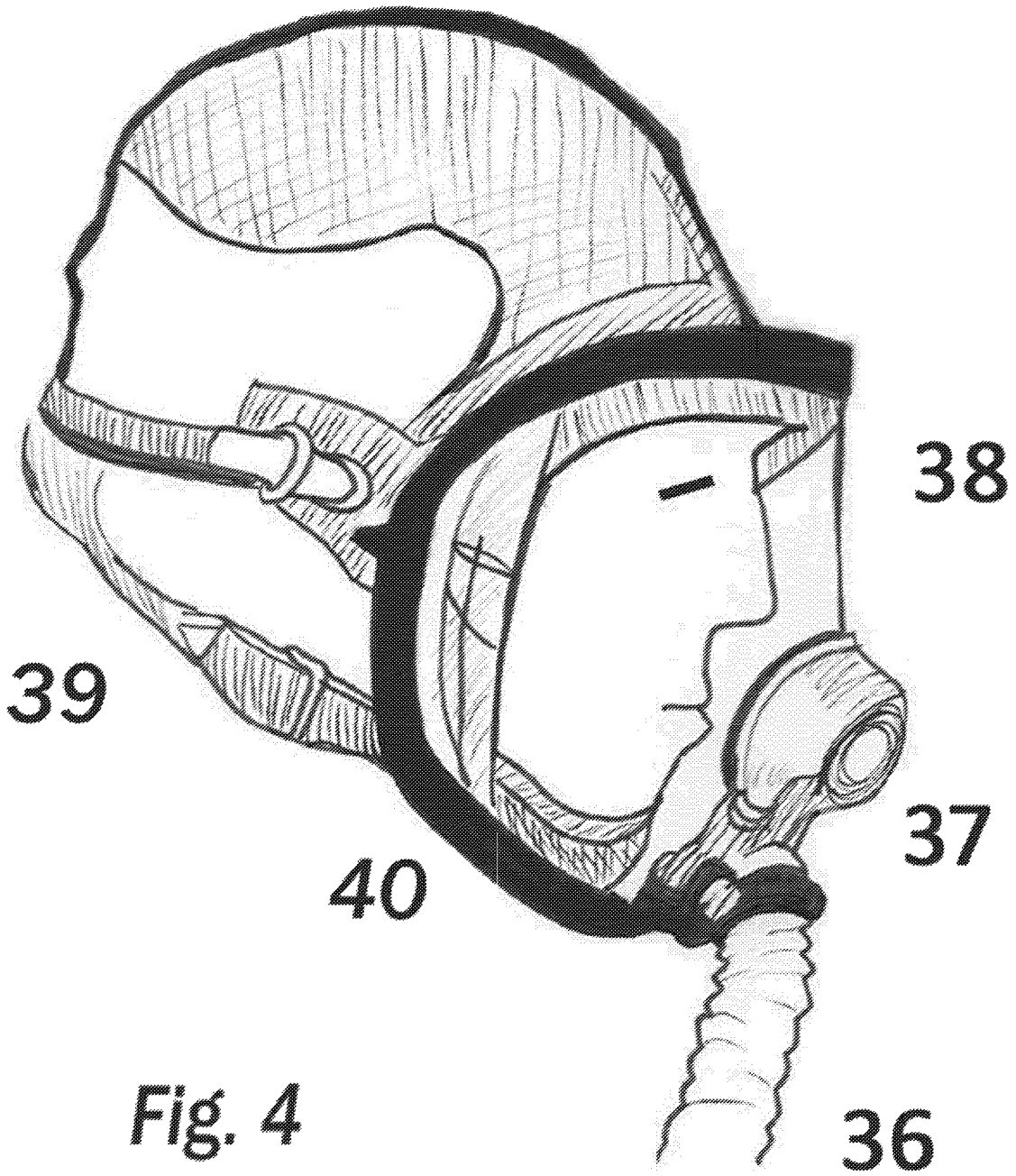
FIG. 4 is a detailed view of the fresh air breathing masks used in the present invention of FIG. 1, items 25, 26, 27, and 28 in FIG. 1.

FIG. 4 shows the fresh air breathing apparatus used by each spray operator for breathing externally supplied filtered fresh air that also keeps the facemask cool so that the operator can work cleaner, cooler and safer without the workplace environmental concerns of overspray and the potential damage to lungs and eyes. Air is sourced at 36 from the regulator 14 of FIG. 1. Air pressure adjustment is made at 37 and breathing chamber 38 contains a clear face mask allowing the operator to have good vision. The breathing chamber 38 is sealed by rubber cushion 40 around the circumference of the breathing chamber so that cool air is held close to the face to help reduce heat fatigue. The mask is attached to the operator by means of adjustable straps 39 that fit under the chin at the bottom and around the neck, ears and forehead at the top. This is one typical version of a standard fresh air operating system used and others types exist and are equally compatible with the present invention.

Figures 5A, 5B:
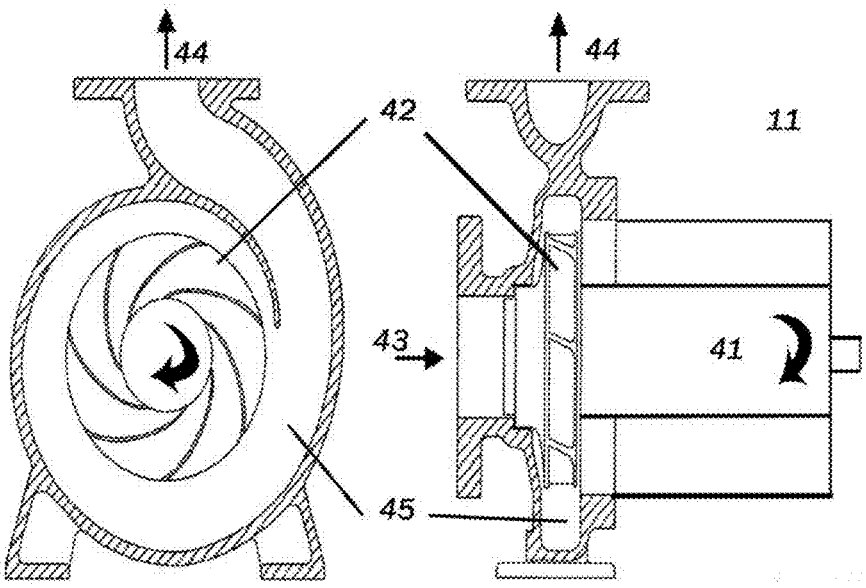
FIG. 5A and FIG. 5B are detailed views of the hydraulic coatings pump used in the present invention of FIG. 1.

FIG. 5A shows side view of the Hydraulic pump 11 of FIG. 1 and FIG. 5B shows a cross sectional view. Electric motor 41 rotates a vane turbine 42 that creates an input vacuum at 43 where coatings are pulled from reservoir 13 of FIG. 1. The pump volute 45 allows for space within the casing for liquid to channel through and as the turbine 42 rotates coating material is exhausted from output 44 into the system and to the regulator 12 of FIG. 1. The coating material then travels to each spray gun fluid input at 32 and remains at the pressure set by the regulator 12. This is one typical version of a hydraulic pump system used for moving coatings and others types exist and are equally compatible with the present invention.

Figure 6:
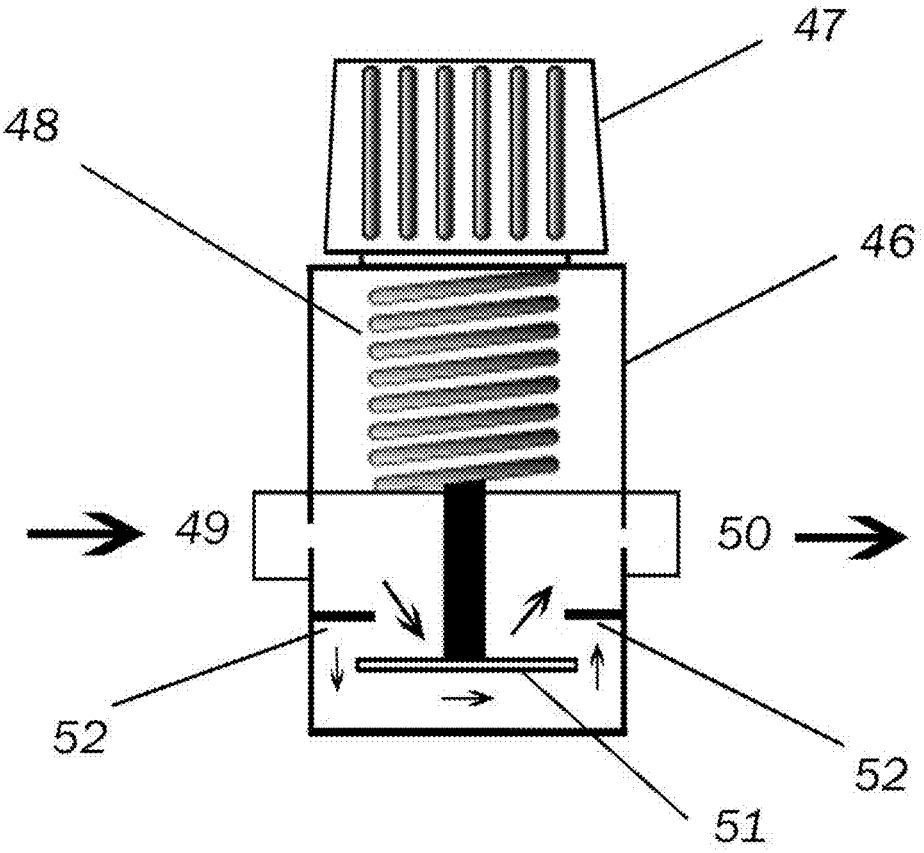
FIG. 6 is a detailed view of the air and liquid pressure controls used in the present invention of FIG. 1, items 12, 14, 17, 18, 19, and 20 of FIG. 1.

FIG. 6 shows a cross sectional view of the internal working of an air or liquid pressure regulator, items 12, 14, 17, 18, 19, and 20 of system drawing shown by FIG. 1. Air or liquid enters the regulator at 49 and is allowed into the pass chamber 52 by adjustment of spring loaded screw 48 via knob 47, within the valve casing 46. The screw moves a flat pass plate 51 which controls the amount of air or liquid that is allowed to through the pass chamber 52 and on to the output of the regulator 50. This is one typical version of a pressure regulator for controlling air or liquid pressures and others types exist and are equally compatible with the present invention.

FIG. 7 shows a schematic version of the present invention connected to multiple spray pods 54 and 55. In this embodiment the design of FIG. 1 shown below the pods is equipped with a command and control computer 53, that receives sensory inputs from the rotary vane pump 1, the hydraulic pump 11, the drive train of the mobile vehicle 10 via wheels 29, 30, the manifold 15, the coating supply container 13, the coating pressure regulator 12 shown at Point C, the fresh air regulator 14 shown combined at Point B, and air gun regulators 17, 18, 19, 20 shown combined at point A. Each of these control lines provides sensor data to the computer and send back control signals from the computer to regulate these devices. The computer keeps tracks of all the various functions involved in the spray operation via the feedback sensors placed throughout the system and sends commands controlled by internally programmed software. It can receive WIFI or Bluetooth radio signals at antenna 56 from any operator or outside source for further command and control of the coating delivery system. The gun air supply is combined and simplified for drawing purposes at A. Likewise the breathing apparatus supply lines are combined and simplified at point B and the coating supply lines at point C. By this means the basic design of FIG. 1 can, with added computer, sensory and command electronics, control multiple groups of painters in multiple pods of HVLP spraying with multiple coatings at multiple locations on a single large target, effectively multiplying the productivity and cost efficiency of the coating operation. There are many other possible variations of these preferred embodiments. Accordingly, any and all modifications, variations or equivalent arrangements which occur to those skilled in the art should be considered to be within the scope and spirit of the present invention as defined by the claims that follow.

What is claimed is:

1. A method of applying coating solutions to a surface using High Volume, Low Pressure technology to maximize transfer efficiencies and application performance, the method comprising the steps of;

A. placing said coating solutions in a flowable condition either in a spray gun cup or within pressurized lines attached to atomizing spray guns;

B. attaching a Rotary Vane Pump of minimum specific capacity in volume and pressure as an air source to an intake manifold;

C. using said manifold as a dynamic storage container for the said pressure source and connecting the atomizing spray guns directly to the manifold for maximum volume of air to be applied to the atomizing guns;

D. using large diameter capacity hoses to transfer air from the manifold to at least one of said atomizing guns to maximize the volume of air applied for atomizing said flowable coating material;

E. establishing pressure regulators within the manifold for individually regulating air pressure to each atomizing gun;

F. using a pressure relief valve within the manifold to maintain a constant pressure delivered to the atomizing guns and limit cross modulation of pressures between atomizing guns.

2. An apparatus for dispensing coating solutions comprised of;

A Rotary Vane Pump that produces at least 15 Pounds Per Square Inch (PSI) of pressure and at least 60 Cubic Feet per Minute (CFM) of air volume; a manifold that accepts compressed air from said pressure source and couples it directly to at least one atomizing gun, without use or need for external air tank storage or containment device; large diameter air hoses ⅜" diameter or greater to couple larger volumes of compressed air from manifold to an atomizing gun cup and/or atomizing chamber; a manifold which contains adjustable pressure regulators for each atomizing gun output; a manifold that maintains a constant pressure within and limits cross modulation between air flowing to individual said atomizing guns by using a pressure relief check valve; a manifold without a limiting storage element, capable of allowing the maximum volume of air from the pressure source to be applied to at least one of said atomizing guns, paint cup or pressurized fluid line, for optimum movement of fluids supplied to at least one of said atomizing guns without the need to create differential pressures between multiple air supply lines to the cup and atomizing pressure feed to at least one of said atomizing guns; the manifold coupled to the large diameter hoses that can connect to both the atomizing gun cup or a direct pressurized coating supply line to allow versatility in use and application.

3. The apparatus according to claim 2, further comprising multiple pods comprising pump source, manifold, coupling hoses and at least one atomizing gun, each connected to the same manifold and synchronized in use by sensory feedback and control devices on each respective pod that regulate the coating application rate, paint flow rate and coating thickness which are relayed to and controlled by a central programmable computer for optimum co-ordination and performance between pods, when used to coat large surface areas requiring consistent coating results from one section covered by a given coating pod to another, and where multiple types of coating materials could be simultaneously applied, requiring extensive co-ordination and control of the process by a control feedback system.

* * * * *